US008894846B2

(12) United States Patent
Yarbro

(10) Patent No.: US 8,894,846 B2
(45) **Date of Patent: *Nov. 25, 2014**

(54) USING SUPERCRITICAL FLUIDS TO REFINE HYDROCARBONS

(76) Inventor: Stephen Lee Yarbro, Los Alamos, NM (US)

( * ) Notice: Subject to any disclaimer, the term of this patent is extended or adjusted under 35 U.S.C. 154(b) by 840 days.

This patent is subject to a terminal disclaimer.

(21) Appl. No.: 12/978,294

(22) Filed: Dec. 23, 2010

(65) Prior Publication Data

US 2011/0163011 A1 Jul. 7, 2011

(51) Int. Cl.

| | |
|---|---|
| ***C10G 31/08*** | (2006.01) |
| ***C10G 29/00*** | (2006.01) |
| ***C10G 21/06*** | (2006.01) |
| ***C10G 1/04*** | (2006.01) |

(52) U.S. Cl.

CPC ..... *C10G 1/047* (2013.01); *C10G 21/06* (2013.01); *C10G 31/08* (2013.01); *C10G 2300/4006* (2013.01); *C10G 2300/4012* (2013.01)

USPC ..... 208/298; 208/391; 208/390; 208/106; 208/416

(58) Field of Classification Search

CPC ..... C10G 1/04; C10G 31/06; C10G 31/08; C10G 1/047; C10G 21/06; C10G 21/08; C10G 21/28; C10G 47/32

USPC ..... 208/298, 390, 391, 952, 106, 415, 416, 208/417; 96/221; 95/31, 34, 289; 210/176, 210/775

See application file for complete search history.

(56) References Cited

U.S. PATENT DOCUMENTS

| | | | | |
|---|---|---|---|---|
| 2,541,070 A | * | 2/1951 | Jones et al. | 208/308 |
| 3,989,618 A | | 11/1976 | McCollum | |
| 4,005,005 A | * | 1/1977 | McCollum et al. | 208/391 |
| 4,818,370 A | | 4/1989 | Gregoli | |

(Continued)

FOREIGN PATENT DOCUMENTS

| | | | |
|---|---|---|---|
| JP | 10314765 | * | 2/1998 |
| JP | WO/2011/048642 | | 4/2011 |

OTHER PUBLICATIONS

Supercritical Fluid Tech, Inc.,"Subcritical/Supercritical Water Systems," website, 2 pages, http://www.supercriticalfluids.com/products/custom-solutions/subcriticalsupercritical-water-systems; last accessed Aug. 16, 2013, available online by Dec. 6, 2012.

(Continued)

*Primary Examiner* — Prem C Singh
*Assistant Examiner* — Brandi M Doyle
(74) *Attorney, Agent, or Firm* — Rod D. Baker

(57) ABSTRACT

This is a method to reactively refine hydrocarbons, such as heavy oils with API gravities of less than 20° and bitumen-like hydrocarbons with viscosities greater than 1000 cp at standard temperature and pressure using a selected fluid at supercritical conditions. The reaction portion of the method delivers lighter weight, more volatile hydrocarbons to an attached contacting device that operates in mixed subcritical or supercritical modes. This separates the reaction products into portions that are viable for use or sale without further conventional refining and hydro-processing techniques. This method produces valuable products with fewer processing steps, lower costs, increased worker safety due to less processing and handling, allow greater opportunity for new oil field development and subsequent positive economic impact, reduce related carbon dioxide, and wastes typical with conventional refineries.

4 Claims, 4 Drawing Sheets

(56) References Cited

U.S. PATENT DOCUMENTS

| | | | | |
|---|---|---|---|---|
| 4,840,725 | A * | 6/1989 | Paspek | 208/130 |
| 7,081,196 | B2 | 7/2006 | Cullen | |
| 7,144,498 | B2 | 12/2006 | McCall | |
| 7,740,065 | B2 | 6/2010 | Choi | |
| 7,754,067 | B2 | 7/2010 | Allam | |
| 7,871,512 | B2 | 1/2011 | Cullen | |
| 8,025,790 | B2 | 9/2011 | Choi et al. | |
| 8,216,520 | B2 | 7/2012 | Choi et al. | |
| 8,394,260 | B2 | 3/2013 | Choi | |
| 8,585,801 | B1 * | 11/2013 | Bryan et al. | 95/34 |
| 2006/0180503 | A1 * | 8/2006 | Rendall | 208/390 |
| 2007/0007168 | A1 * | 1/2007 | Zhao et al. | 208/45 |
| 2007/0056881 | A1 | 3/2007 | Berkowitz | |
| 2008/0099374 | A1 * | 5/2008 | He et al. | 208/177 |

OTHER PUBLICATIONS

Prabhudesai, R. K. et al, "Thermal Diffusion as a Purification Tool," Annals of the New York Academy of Sciences, Jan. 1966, pp. 83-102, vol. 137, USA.

Lindsey, E. E. et al. "Distillation in a Multitube Wetted-Wall Column," Industrial & Engineering Chemistry, 1952, pp. 225-231, vol. 44, No. 1, Amer. Chem. Society, USA.

John Reynolds, Ann Murray, Eric Nuxall, Glenn Fox, "Upgrading of Heavy Oil from the San Jaoquin Valley of California using Aqueous Pyrolysis", Lawrence Livermore National Laboratory, UCRL-ID-122472, Oct. 1, 1995 USA.

C. Thorsness, W. Miller, "A Process and Economic Model of In-Field Heavy Oil Upgrading using Aqueous Pyrolysis", Lawrence Livermore National Laboratory, UCRL-ID-126220, Jan. 21, 1997 USA.

H. Kamimura, S. Takahashi. A. Kishita, T. Moriya, C.X. Hong, H. Enomoto, "Upgrading of Bitumen with Supercritical Water for a System Combined with SAGD", Symposium on Fuels for the year 2000 and Beyond, Am. Chem. Soc., Division of Fuel Chemistry, Boston USA Aug. 1998.

Zhen-Min Cheng, Yong Ding, Li-Qun Zhao, Pei-Qing Yuan, Wei-Kang Yuan, "Effects of Supercritical Water in Vacuum Residue Upgrading", Energy and Fuels, 23, 3178-3138, 2009 USA.

M. Morimoto, Y. Sugimoto, Y. Saotome. S. Sato. T. Takanohashi, "Effect of Supercritical Water on Upgrading Reaction of Oil Sand Bitumen", Journal of Supercritical Fluids, 55(1), 223-231, Nov. 2010 USA.

D. Miyamoto, A. Kishita, F. Jin, T. Kazuyuki, H. Enomoto, "Upgrading of Bitumen in Supercritical Water: Activation of Water", AIP Conference Proceedings 898, 123-125 Nov. 2006 USA.

A. Kishita, N. Watanabe, J.V. Perez, "Observation of the Heavy Crude Oil Dissolution Behavior under Supercritical Condition of Water", International Petroleum Technology Conference, Dec. 7-9, 2009, Doha, Qatar ISBN 978-1-55563-264-9.

T. Kayakawa, "Upgrading of Bitumen by using Supercritical Water", 5th NCUT Upgrading and Refining Conference 2009, Edmonton, Alberta, Canada, Sep. 14-16, 2009.

* cited by examiner

USING SUPERCRITICAL FLUIDS TO REFINE HYDROCARBONS

STATEMENT REGARDING FEDERALLY SPONSORED R&D

This invention was made with Government support under Contract No. DE-AC52-06NA25396 awarded by the U.S. Department of Energy to Los Alamos National Security for the management and operation of the Los Alamos National Laboratory. The Government has certain rights in this invention.

BACKGROUND OF THE INVENTION

1. Field of the Invention

The present invention relates to using a supercritical fluid, typically water, with or without additives such as inorganic salts, selected hydrocarbons, or other soluble elements or compounds such as oxygen, air, carbon monoxide or carbon dioxide to successfully refine hydrocarbons, such as heavy oil, bitumen and bitumen-like hydrocarbons. Heavy oil is a hydrocarbon with API gravity lower than 20° often containing sulfur compounds and associated heavy metals that are removed as part of the upgrading process. Bitumen or bitumen-like is defined as any hydrocarbon with a viscosity greater than 1000 cp at standard temperature and pressure. Supercritical fluids or fluid mixtures, typically water extracts the heavy oil/bitumen from a solid then thermally split the higher molecular weight hydrocarbons into lighter, more volatile hydrocarbons of higher value. The reaction portion of the method delivers the lighter weight, volatile hydrocarbons to a multi-phase contacting device that uses a thermal gradient to separate the hydrocarbon mixture into portions that are viable for use or sale without further refining.

2. Description of the Prior Art

World oil supply is changing and the readily available medium to light crude oil reserves are getting harder to find and develop. Since the world energy demand is increasing, particularly in emerging economies such as India and China, heavier oil reserves will be necessary to meet the demand as an alternative to more exploration and developing conventional oil reserves. Recovery and field development techniques for unconventional reserves have been progressing, such as steam assisted gravity drainage (SAGD), but current refining technology is based on combinations of feed desalting, high-vacuum distillation, and then conventional hydrocracking or a combination of coking, thermal cracking followed by some form of hydro-processing using various catalysts and process gases. This requires complex, expensive equipment and an involved refinery infrastructure that includes capacity to produce hydrogen, heating fuel and maintain equipment and supplies. The conventional approach also generates large amounts of carbon dioxide from the heating required to drive the main distillation column, associated upstream, and downstream processing. The inventor believes that the concept presented here can produce similar products with fewer processing steps and therefore lower costs, increase worker safety due to fewer process steps and less reagent handling, allow greater opportunity for new oil field development and subsequent positive economic impact, reduce the amount of carbon dioxide, and associated waste products typically associated with conventional refineries.

U.S. Pat. No. 3,989,618 discloses a process for upgrading a hydrocarbon fraction by contacting the hydrocarbons with a supercritical water over a temperature range of 600° F. to 900° F. with no catalyst of added hydrogen. However, other additives are an important part of the process as the description goes on to add that it is useful to add a biphenyl, pyridine, a partly hydrogenated aromatic oil, or a mono- or polyhydric compound such as methanol to the water to add in the hydrocarbon upgrading process. The process as described can be carried out in a batch, semi-continuous or continuous fashion requiring minutes up to six hours of contact for satisfactory removal of sulfur, various metallic compounds and producing lighter hydrocarbon compounds.

The method is limited by mentioning that using carcinogens such as aromatic hydrocarbons aids the reaction process even though the process does not require a typical 'cracking' catalyst or added hydrogen. The aromatic hydrocarbons provide an in-situ source of hydrogen with the penalty of having to add reagents to allow operation at lower temperatures and pressures. In addition, the process does not provide a method for how to handle the unreacted portion of the feed or a means to control the reaction so that the product distribution can be controlled.

U.S. Pat. No. 4,818,370 discloses a process for upgrading heavy oil in a subterranean reservoir using supercritical 'brine' in combination with in-situ combustion to provide heat. The 'brine' is salt water typically found in oil reservoirs. An oxidizing gas in injected into the reservoir to enable a combustion zone that heats the heavy oil to allow it to drain into the combustion zone which contains the brine and is heated and pressurized to supercritical conditions. After a suitable time, the heavy oil is converted to lighter components that are removed from the reservoir using conventional recovery methods.

The method is limited to working with heavy hydrocarbons in-situ and the efficiency of the said method is dependent on the reservoir conditions and physical properties. No method is described to provide control of the reaction conditions such as the rate, contact times, reagent ratios, temperature, or pressure. It would be difficult to ensure that optimal conditions are maintained to get the best product distribution. In addition, it requires additional means to inject oxidizing gases and recover the combustion gases that contribute to the carbon footprint of the process.

U.S. Patent Publication 2007/0056881 A1 discloses a method for upgrading heavy hydrocarbons and the like using a flow-through reactor to contact heavy hydrocarbons with water at temperatures ranging from 250° C. to 450° C. and pressures ranging from 500 psi to 3000 psi. Said method uses simple reactor with inlets ports for the water and the hydrocarbons into the reactor, and an outlet port that directs the water-oil mix to a cooler that cools the mixture and allows separation. Other conditions described are the residence times from 28 seconds to 10 minutes and the additional allowance to introduce carbon monoxide or selected inert gases such as nitrogen into the reactor.

The method does not describe means to control the product distribution or quality or means to deal with unreacted heavy hydrocarbons. It is known that any heavy oil or bitumen processing method produces coke or other refractory carbonaceous material that must be handled in some fashion. This invention does not describe a method for handling carbonaceous residues that can be deleterious to reactor operation.

U.S. Pat. No. 7,754,067 discloses a method for upgrading heavy hydrocarbons and the like using supercritical water, means for contacting the hydrocarbons and supercritical water in two separate heating stages. In the first zone, heavy hydrocarbons are mixed with supercritical water at pressures above 22.1 MPa at temperatures up to 775 K in the first heating zone, and then the second zone is heated either by an external source or by bleeding in oxygen to in-situ heat the fluid up to 870 K to 1075 K. The said device is also has a convoluted or multi-pass contacting device with a nozzle device to try to disperse the hydrocarbons into the supercritical water.

The method is limited by the formation of solid carbonaceous materials that necessitate the shutdown and clean out of the reactor. The multi-pass portion required to effect the necessary mixing also limits the means to effectively clean and maintain the contacting device. In addition, the heating profile described is complex and requires shortened heat-up times between the heating stages to reduce coke formation. This limits the operating time and potential throughput of the method.

U.S. Pat. No. 7,144,148 B2 discloses a method for upgrading heavy oil and the like using a supercritical solvating hydrocarbon and means for contacting the heavy oil and solvating solvent using a fluidized bed of hot solids. The heavy hydrocarbons are contacted with the supercritical solvating hydrocarbon in a first fluidized bed at temperatures at or below 538° C. with the solid particulates providing a method for heat transfer. After reaction, the lighter hydrocarbons are removed and the solids transported to a second bed to remove accumulated coke formation.

The method is limited by using a solvating hydrocarbon to essentially dissolve and then react with the heavy hydrocarbons. This necessitates a solvent removal and recycle step along with handling the solid particulates used to transfer heat to the reaction mixture. An additional solids removal step is required to prevent the solid particulates from affecting downstream processing.

SUMMARY OF THE INVENTION

An embodiment of the supercritical fluid refining apparatus and method upgrades and separates the components of heavy hydrocarbons, such as heavy oils with API gravities of less than 20° and bitumen-like compounds with viscosities greater than 1000 cp measured at standard conditions. The embodiment uses a supercritical fluid, typically water, with or without additives such as inorganic salts, selected hydrocarbons, or other soluble elements or compounds such as oxygen, air, carbon monoxide, or carbon dioxide.

A supercritical fluid efficiently dissolves and extracts the heavy oil/bitumen from a porous solid then thermally splits the higher molecular weight hydrocarbons to lighter, more volatile hydrocarbons. The lighter weight, more volatile hydrocarbons are then introduced to a contacting portion. In this manner, the supercritical reaction portion is similar in concept to a "reboiler" on a conventional distillation column with the difference being that the supercritical reaction portion delivers a different set of compounds that can be further separated with a thermal gradient as opposed to just separating compounds due to volatility.

A thermal gradient across the contacting portion separates the hydrocarbon mixture into portions to use or sell without further complex and expensive conventional refining and hydro-processing. The reaction portion of the system introduces the lower-boiling compounds to a contacting portion at the same or lower pressure as the reaction portion.

In a first embodiment, a thermal and pressure gradient is imposed to gradually condense the various compounds at various stages throughout the length of the contacting portion and counter-currently mix the condensed and non-condensed phases until the mixture is partially or completely condensed at the final stage and a portion is returned to the system as reflux. In this manner, the contacting portion operating in a mixed subcritical and supercritical mode can deliver various product compositions and the reaction portion can deliver lower boiling components in various combinations to enhance the performance of the contacting portion. In addition, the reaction portion removes solids that form from the various metals or salts present in the heavy hydrocarbon feed. Periodically, it removes any carbonaceous material formation by adding air or oxygen to the supercritical fluid, typically water, to oxidize any deposited solid carbonaceous material in the reaction and contacting portions.

In a second embodiment, a thermal gradient in the contacting portion at constant pressure separates compounds based on isotopic weight, molecular size and/or shape or other physical properties. This embodiment uses the concept of circulating a single phase that allows diffusion to concentrate different compounds in different regions of the contacting portion.

It is therefore a primary object of the present invention to provide a method for refining hydrocarbons such as heavy oil or bitumen-like hydrocarbons without using complex, expensive conventional refining and hydro-processing.

It is another object of the present invention to provide a method for upgrading heavy oil or bitumen-like hydrocarbons at a significant cost savings by avoiding the need for additional reagents such as hydrogen, solvating hydrocarbons or expensive solid catalysts and equipment.

It is another object of the present invention to provide a method for upgrading heavy oil or bitumen-like hydrocarbons that will produce a lesser amount of carbon dioxide from the heating operations than the amounts associated with conventional refining, and that will reduce the carbon footprint for producing high-value hydrocarbons.

It is still a further object of this invention to upgrade heavy oils and bitumen-like hydrocarbons to provide a method that will produce reduced amounts of coke and solid carbonaceous material when compared to other methods.

It is still a further object of this invention to upgrade heavy oils and bitumen-like hydrocarbons with a method that allows for recycle of process material, and with better process control, than known heavy oil upgrading techniques that propose using supercritical fluids.

It is still a further object of this invention to upgrade heavy oils and bitumen-like hydrocarbons with a method that enhances the safety of process operators by reducing processing complexity and by reducing or eliminating combustible and hazardous reagents.

These and other objects of the present invention, will become apparent to those skilled in the art upon reading the accompanying description, drawings, and claims set forth herein.

DETAILED DESCRIPTION OF THE INVENTION

Figure 1:
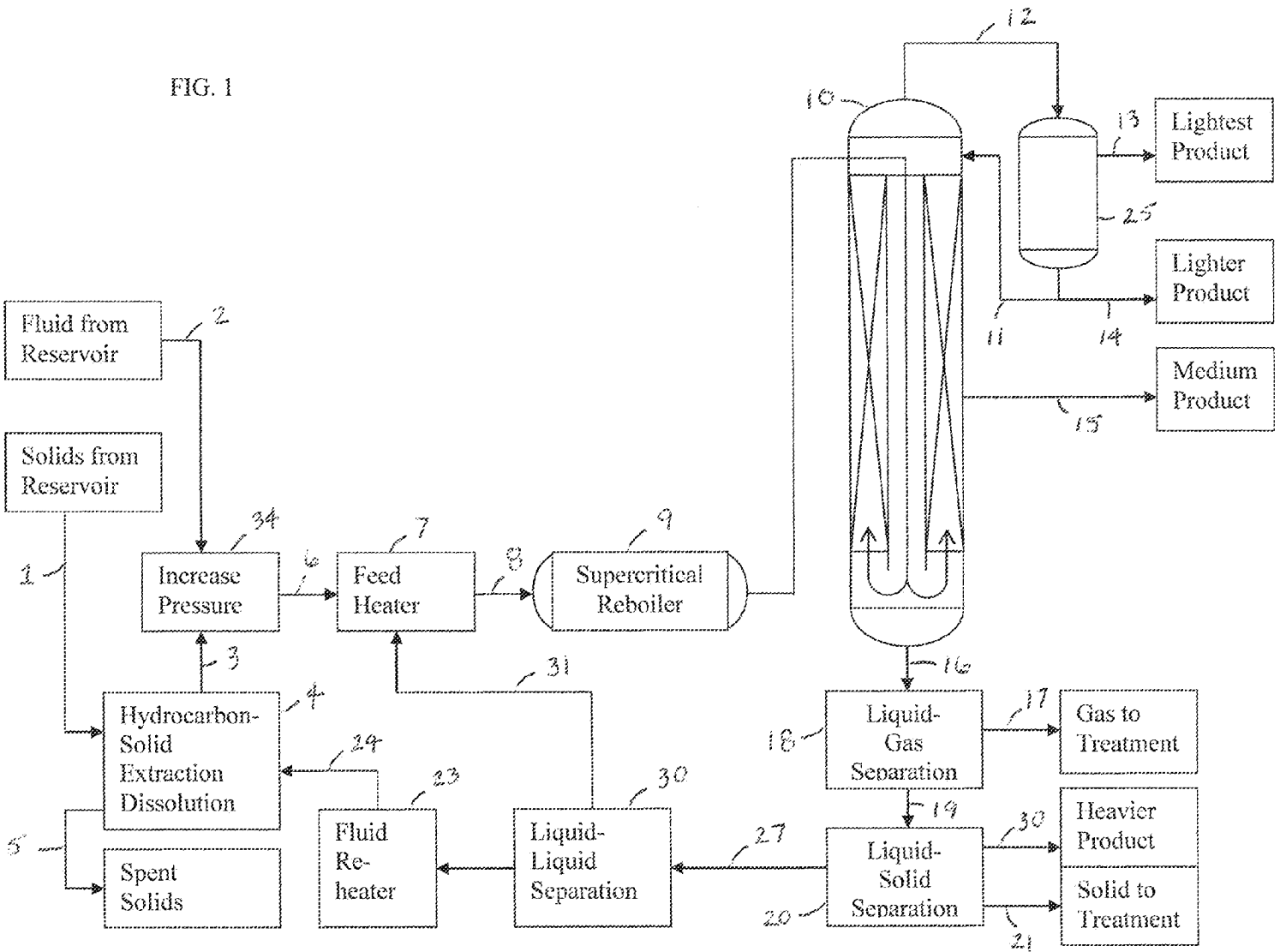
FIG. 1 is a simplified schematic of a processing configuration of an embodiment of the present invention wherein heavy oil or bitumen-like material extracted from oil-bearing solids or from thermal fluid recovery from a reservoir is subsequently processed in a supercritical fluid system.

FIG. 1 shows a process schematic of the best mode contemplated by the inventor of using supercritical fluid or fluid mixtures, typically water, to refine heavy oil and bitumen-like compounds in a reaction portion including a reboiler 9, and a contacting portion including a vessel 10, according to the concepts of the present invention. As can be seen from the drawings, a supercritical fluid or fluid mixture 24 dissolves heavy oil or bitumen-like compounds 1 from a solid substrate 4. The supercritical fluid with hydrocarbons 3 can be mixed with a thermal recovery fluid, typically steam 2 from the reservoir, or used alone as a feedstock 6 to be further pressurized in unit 34. The mixture 6 consisting of a fluid, typically water or water mixture and heavy hydrocarbons, is sent to a heating unit 7. The heating unit 7 heats the fluid to temperatures in the supercritical regime at that pressure for that fluid, delivers the stream 8 to a supercritical reboiler 9, and then to an associated multi-phase contacting portion 10. Product is removed from the multi-phase contacting portion 10 (depending on its volatility or other physical or chemical properties) at tap line 12 for lighter compounds, tap line 15 for medium compounds, or tap line 16 for heavier compounds. Liquid-gas separation 18 and liquid-solid separation 20 allow column maintenance and enhance operation depending on the feed composition. Un-reacted material can be recycled via lines 31 or 11.

Figure 2:
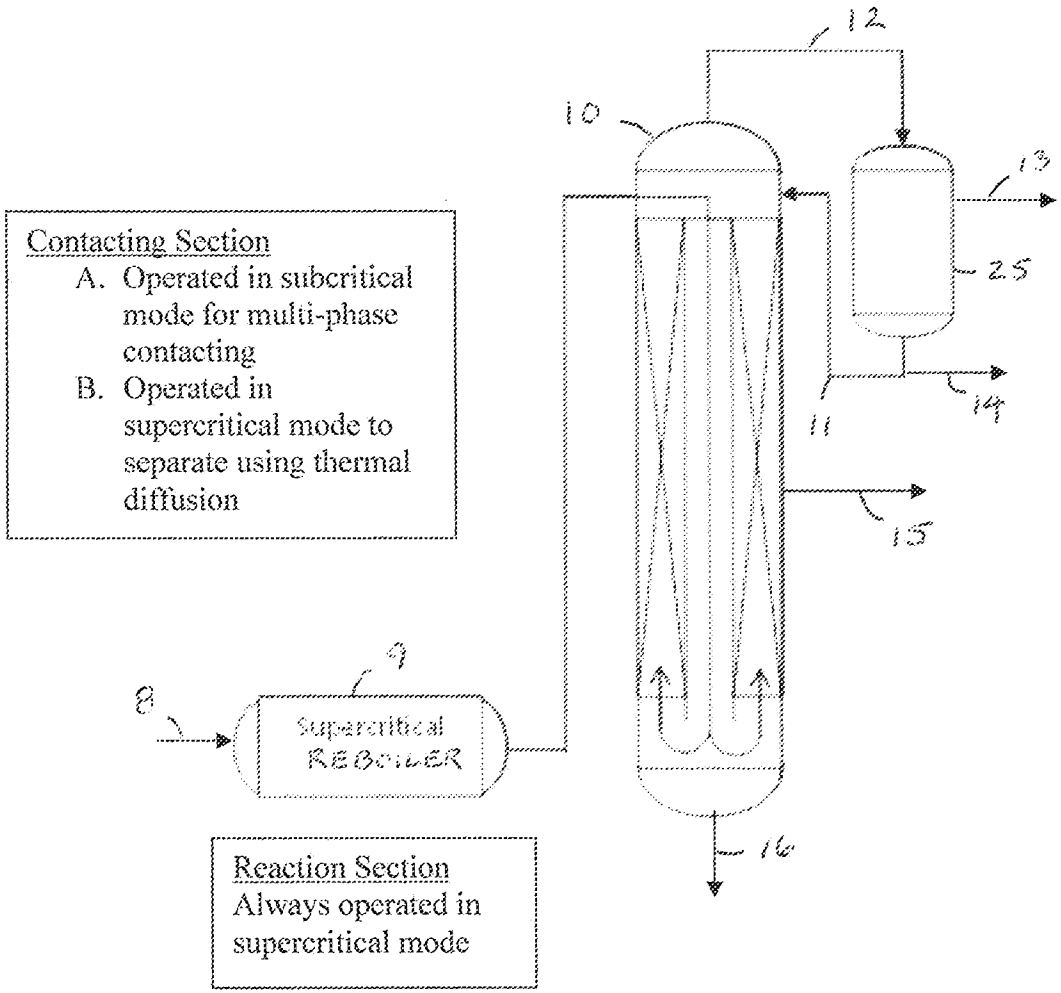
FIG. 2 is a detail schematic of a portion of the processing configuration of an embodiment of the present invention shown in FIG. 1, describing operating modes of an associated contacting portion.
Figure 5:
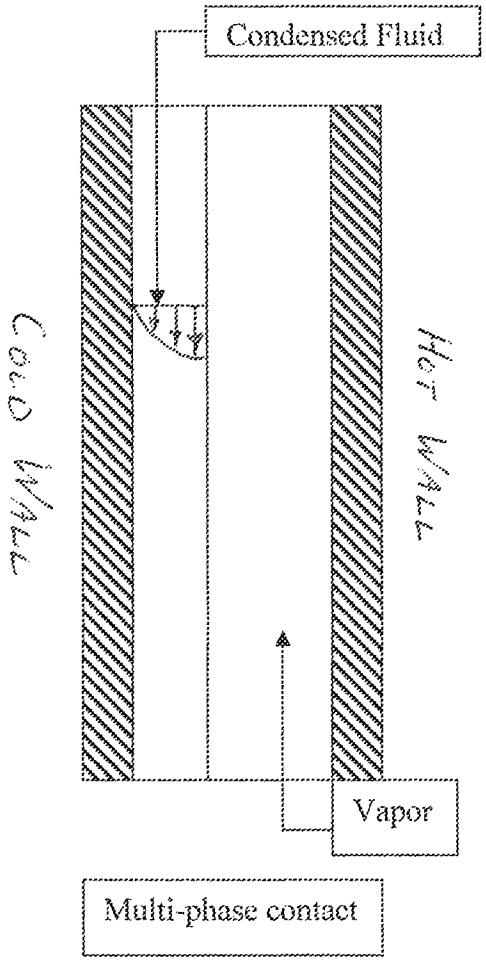
FIG. 5 is a sectional schematic of a contacting portion of an embodiment of the process and apparatus, illustrating the use of multi-phase contact to separate hydrocarbons in a supercritical fluid.

FIG. 2 is a simplified process schematic for the reaction portion of the contemplated best mode of the invention . The supercritical reboiler 9 of the reaction portion operates at supercritical conditions for the chosen fluid or fluid mixture, and the phase contacting portion 10 can operate, in different embodiments, at temperatures and pressures over the chosen fluid or fluid mixture subcritical temperature-pressure regime. Therefore, as seen in FIGS. 1 and 2 a temperature gradient is imposed inside an enclosed volume of the contacting portion 10 with the appropriate inner structure (such as plates, packing, concentric tubes, divided walls) having a hot wall and a cold wall (as seen in FIG. 5) that promote appropriate phase contact for that mode of operation. The supercritical reboiler 9 is operated at supercritical conditions for the chosen fluid or fluid mixture, typically water, between 23 MPa and 70 MPa and between 450° C. and 950° C. It is recommended that the phase contacting portion 10 be operated so that a "pool" of condensed fluid can be formed to remove any insoluble solids that may be formed at the conditions in the contacting portion of the system, thus solving a problem with other systems using supercritical fluid or fluid mixtures. The fluid mixture stream in tap line 16 can be separated into a stream for treatment and possible discard, or return un-reacted hydrocarbon components for processing. This overcomes the problem of dealing with un-reacted hydrocarbons, encountered in other systems using supercritical fluid or fluid mixtures.

Figure 3:
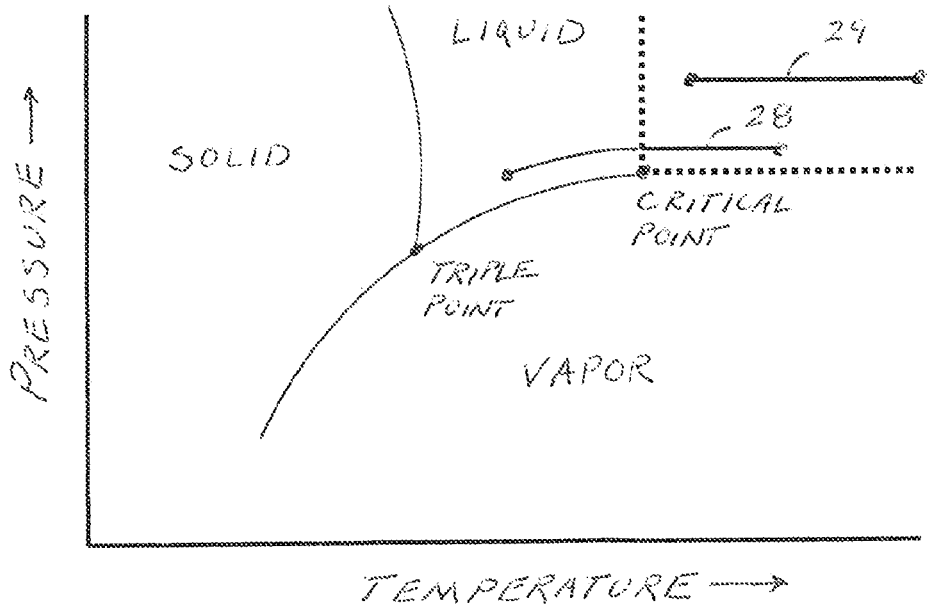
FIG. 3 is a generic fluid pressure-temperature diagram showing a possible operation lines for embodiments of the method and apparatus.

FIG. 3 shows possible thermal operating lines illustrating the concept for the contacting portion of a first embodiment of the system. FIG. 3 does not constrain the operating conditions for the system, but serves to illustrate how the conditions vary from supercritical to subcritical within the contacting portion by changing the pressure and temperature and therefore be operated in a mixed subcritical supercritical mode or in only a supercritical mode. Heavy hydrocarbons react in the supercritical fluid or fluid mixture in the supercritical reboiler 9 in a manner that produces lighter, more volatile components or compounds with different molecular weights or other chemical or physical properties. In an embodiment of the invention, the multi-phase contacting portion 10 operates at the same or slightly lower pressure than the supercritical reaction portion of the device 9. The lighter components then travel up the contacting portion and medium weight components can be removed at the appropriate location 15. The lighter and lightest components removed via tap line 12 can be partially condensed 25 and taken off 13 and 14 and a portion returned to the system to provide additional enrichment of selected components thus allowing a range of feed components to be processed which provides a wider range of application for the process. In this mixed subcritical supercritical mode, the thermal gradient 28 as shown in FIG. 3 will effect a phase change and allow separation in the contacting portion of the water hydrocarbon mixture. The contact of the different phases (FIG. 5) enriches certain components and further fractionate the compounds into higher value hydrocarbon materials.

Figure 6:
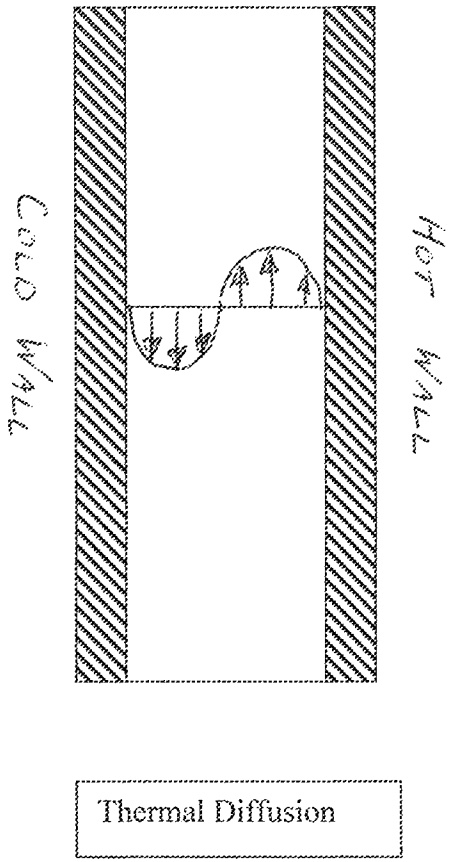
FIG. 6 is a sectional schematic of a contacting portion of an alternative embodiment of the process and apparatus, illustrating the separation of hydrocarbon compounds using thermal diffusion in a supercritical fluid.

FIG. 3, together with FIG. 6, shows a second embodiment of the present invention. A temperature gradient 29 is imposed while maintaining a constant pressure so that the contacting portion 10 operates in the supercritical pressure-temperature regime for the chosen fluid or fluid mixture. It is believed that in this mode, thermal diffusion of the various compounds within a single phase effects a separation of components, isomers, and isotopes having close boiling points. It is believed further that higher thermal diffusion coefficients, usually an order of magnitude larger in supercritical fluids than in liquids, enable separation of close-boiling components, such as isomers and isotopes in mixtures. Therefore, a temperature gradient is imposed within the contacting portion's enclosed volume containing the appropriate inner structure, such as plates, packing, concentric tubes, divided walls or the like, having a hot wall and a cold wall (as seen in FIG. 6) that promotes appropriate single phase contact for that mode of operation. Both the reboiler 9 of the reaction portion and the contacting portion 10 operate at supercritical conditions for the chosen fluid or fluid mixture, and components are separated by a temperature gradient applied within the process envelope for supercritical conditions. Both the supercritical reboiler 9 and the contacting portion 10 operate at supercritical conditions for the chosen fluid or fluid mixture, typically water, typically between 23 MPa and 70 MPa and between 450° C. and 950° C. The lighter components then travel up the contacting portion, and medium weight 15 components can be removed at the appropriate location. The lighter and lightest components in tap line 12 can be separated 25 and taken off 13 and 14 or a portion returned to the contacting portion 10 to provide additional enrichment of selected components thus allowing a range of feed components to be processed which provides a wider range of application for the process. It is recommended that any supercritical part of the contacting portion 10 be operated so that condensed fluid can be formed to remove any insoluble solids that may be formed at the conditions in that part of the contacting portion, thus solving a problem with other systems using supercritical fluid or fluid mixtures. The fluid mixture stream 16 can be separated into a stream for recycle 31 that overcomes the problem of dealing with unreacted hydrocarbons, as is the case with other systems using supercritical water or water mixtures.

Figure 4:
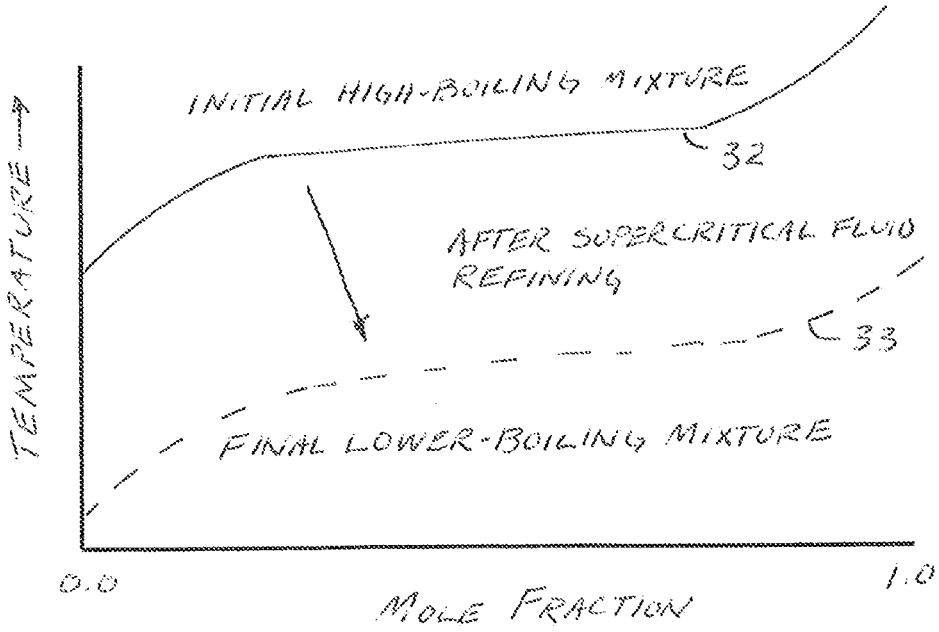
FIG. 4 is a temperature-mole fraction graph of a typical true boiling point curve, illustrating how the curve can be shifted for improved refining or thermal diffusion separation via supercritical reaction.

The problems addressed by using supercritical water or water mixtures are further understood in reference to FIG. 4. FIG. 4 shows how the higher boiling point mixture reacts, forming a mixture of lower boiling compounds that can be separated in the contacting portion operating in either subcritical or supercritical mode, depending on the most efficient method for separating a particular feed. The supercritical fluid, typically water, refining approach implemented in the supercritical reboiler 9 and the vessel 10 of the contacting portion can avoid using complex, expensive conventional refining techniques that require special reagents, such as hydrogen and expensive catalysts. The supercritical water or water mixture method of the present disclosure also uses less energy than conventional processing, and therefore releases less carbon dioxide to the atmosphere and has a smaller carbon footprint. The present method easily recycles unreacted material and removes coke and heavy carbonaceous deposits that plague other types of technology. It improves personnel safety by reducing the number of processing steps and amount of hazardous reagents.

FIG. 5 is a simplified schematic showing the best mode contemplated for the supercritical fluid refining method as implemented in the contacting portion 10 of the present disclosure. Depending on the feed composition or desired product composition or both, the contacting portion receives from the reaction portion the lower volatility compounds, or compounds with new molecular weights or other chemical or physical characteristics and separates them via different pressure-temperature regimes using multi-phase contact. It is important to couple the supercritical reboiler 9 (of the reaction portion) to the contacting portion to enable the regimes to vary between subcritical and supercritical for the chosen fluid.

FIG. 6 is a simplified schematic showing an alternative embodiment for the supercritical fluid refining method as implemented in the contacting portion 10 of the.0 Depending on the feed composition or desired product composition or both, the contacting portion receives from the reaction portion the lower volatility or compounds with new molecular weights or other chemical or physical characteristics, and separates them via different pressure-temperature regimes using thermal diffusion in a single phase.

Thus it will be appreciated by those skilled in the art that the present invention is not restricted to the particular embodiments described with reference to the drawings, and that variations may be made therein without departing from the scope of the present invention as defined in the appended claims and equivalents thereof.

What is claimed is:

1. A method for using a supercritical fluid to reactively refine hydrocarbons comprising the steps of:

providing supercritical water;

removing heavy oil, bitumen or bitumen-like hydrocarbons from porous hydrocarbon-containing material by mixing the supercritical water with the material to dissolve the hydrocarbons;

mixing the supercritical water with the hydrocarbons to create a supercritical mix;

heating and pressurizing the supercritical mix in a reaction portion to react the supercritical mix to form reaction products having differing molecular weights;

contacting the reaction products in a contacting portion operated in a single phase supercritical mode for the supercritical mix; and imposing a thermal gradient in the contacting portion to effect by thermal diffusion a single-phase separation of close-boiling reaction products, whereby heavy hydrocarbons are reactively refined.

2. The method for using a supercritical fluid to reactively refine hydrocarbons according to claim 1, wherein the step of imposing a thermal gradient to effect single-phase separation of reaction products comprises separating isomers and isotopes in the supercritical mix.

3. The method for using a supercritical fluid to reactively refine hydrocarbons according to claim 1, comprising the steps of removing the supercritical mix and separating the supercritical fluid and hydrocarbons for recycle or use.

4. The method for using a supercritical fluid to reactively refine hydrocarbons according to claim 2, further comprising the step of returning lighter reaction products back to the reacting portion or the contacting portion.

* * * * *